US008139983B2

(12) United States Patent
Sasaki et al.

(10) Patent No.: US 8,139,983 B2
(45) Date of Patent: Mar. 20, 2012

(54) DEVELOPING DEVICE AND IMAGE FORMING APPARATUS WITH LIQUID DEVELOPER COATING MEMBERS

(75) Inventors: Tsutomu Sasaki, Matsumoto (JP); Kazuma Miyazawa, Shiojiri (JP); Masahiro Fukazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 12/608,851

(22) Filed: Oct. 29, 2009

(65) Prior Publication Data

US 2010/0111553 A1 May 6, 2010

(30) Foreign Application Priority Data

Oct. 31, 2008 (JP) ..... 2008-282038

(51) Int. Cl.
*G03G 15/10* (2006.01)

(52) U.S. Cl. ..... 399/239

(58) Field of Classification Search ..... 399/57, 399/239, 240; 430/117.1, 117.3
See application file for complete search history.

(56) References Cited

U.S. PATENT DOCUMENTS

| | | | | |
|---|---|---|---|---|
| 5,555,079 | A | 9/1996 | Adachi et al. | |
| 6,038,421 | A | 3/2000 | Yoshino et al. | |
| 6,868,246 | B2 | 3/2005 | Takeuchi et al. | |
| 7,386,260 | B2 * | 6/2008 | Oda et al. | 399/237 |
| 7,493,065 | B2 * | 2/2009 | Kamijo et al. | 399/239 |
| 7,676,181 | B2 * | 3/2010 | Ueda et al. | 399/239 |
| 7,844,203 | B2 * | 11/2010 | Takano et al. | 399/237 |
| 2004/0005407 | A1 | 1/2004 | Takeuchi et al. | |

FOREIGN PATENT DOCUMENTS

| | | | |
|---|---|---|---|
| EP | 0655660 | A2 | 5/1995 |
| JP | 2000235306 | A | 8/2000 |
| JP | 2002-099151 | | 4/2002 |
| JP | 2002-287513 | | 10/2002 |
| JP | 2005189554 | A * | 7/2005 |
| JP | 2007225951 | A * | 9/2007 |

OTHER PUBLICATIONS

European search report for corresponding European application 09174445.8 lists the references above.
European search report dated Mar. 8, 2010 for corresponding European application 09174445.8 lists the references above.

* cited by examiner

*Primary Examiner* — Robert Beatty
(74) *Attorney, Agent, or Firm* — DLA Piper LLP (US)

(57) ABSTRACT

A developing device includes a developer storage portion that stores a liquid developer including toner and carrier liquid. A first coating member rotates and coats the liquid developer stored in the developer storage portion. A second coating member contacts the first coating member and rotates in a direction opposite to that of the first coating member. A developer supporting body contacts the second coating member and rotates in the same direction as that of the second coating member. A contact member contacts the liquid developer coated on the second coating member by the first coating member.

6 Claims, 12 Drawing Sheets

DEVELOPING DEVICE AND IMAGE FORMING APPARATUS WITH LIQUID DEVELOPER COATING MEMBERS

CROSS-REFERENCE TO RELATED APPLICATIONS

This application claims the benefit of priority under 35 USC 119 of Japanese application no. 2008-282038, filed on Oct. 31, 2008, which is incorporated herein by reference.

BACKGROUND

1. Technical Field

The present invention relates to a developing device that develops an electrostatic latent image formed on an image supporting body, by a liquid developer including toner and carrier liquid, and an image forming apparatus that forms an image by transferring a developer image developed by a developing device to a recording medium and fixing the image.

2. Related Art

A variety of image forming apparatuses have been proposed that develop and visualize an electrostatic latent image by using a liquid developer of high viscosity, in which toner composed of solid components is dispersed in liquid solvent serving as carrier liquid. The developer used in the image forming apparatus is a developer in which solid components (toner particles) are suspended in organic solvent (carrier liquid) of high viscosity which is composed of silicon oil, mineral oil, edible oil, or the like and has electrical insulation properties. As for the toner particle, an extremely minute particle having a particle diameter of approximately 1 μm is used, thereby being able to achieve higher image quality in comparison with conventional dry type image forming apparatuses that use a toner particle having a particle diameter of 7 μm.

JP-A-2002-99151 discloses an image forming apparatus that seeks to improve development efficiency by uniformly coating a liquid developer on a developing roller through the adjustment of the contact pressure of a blade coming into contact with an anilox roller or the adjustment of the rotary speed of the anilox roller.

JP-A-2002-287513 discloses an image forming apparatus in which an intermediate roller is provided between a coating roller and a developing roller and the intermediate roller and the coating roller are rotated at the same speed and in the same direction as each other. According to this image forming apparatus, since the developing roller does not come into direct contact with the coating roller, abrasion and damage due to a recessed portion formed in the surface of the coating roller do not occur, so that the developing roller suffers reduced mechanical stress and its life can be prolonged.

In this manner, in image forming apparatuses that use a liquid developer, a coating roller (anilox roller) having a recessed portion in its surface is used in order efficiently to scoop up liquid developer and, at the same time, precisely measure liquid developer.

However, in a case where the coating roller (anilox roller) with a recessed portion formed in the surface in this way is used, the transfer pattern of liquid developer by the recessed portion appears, thereby leading to unevenness in the film thickness of liquid developer. In particular, in JP-A-2002-287513, as can be seen in the graph of FIG. 8 thereof showing the relationship between the roller velocity ratio of the developing roller and the intermediate roller and the coating amount of liquid developer that is coated on the developing roller, a region where the roller velocity ratio is 1.0 or less becomes a non-uniform region, and therefore cannot be used for image formation.

In an image forming apparatus, the resolution of an image formed can be improved by reducing the coating amount of the developer that is coated on the developing roller (by thinning the film thickness of liquid developer). However, in the image forming apparatus of JP-A-2002-287513, since the lower limit of the coating amount, that is, the film thickness of liquid developer is restricted, higher resolution cannot be realized.

SUMMARY

An advantage of some aspects of the invention is that it provides a developing device and an image forming apparatus, which realize higher resolution of the formed image by increasing the lower limit of the film thickness of liquid developer that is formed on a developing roller.

According to a first aspect of the invention, a developing device includes: a developer storage portion that stores a liquid developer including toner and carrier liquid; a first coating member that rotates and coats liquid developer stored in the developer storage portion; a second coating member that comes into contact with the first coating member and rotates in a direction opposite to that of the first coating member; a developer supporting body that comes into contact with the second coating member and rotates in the same direction as that of the second coating member; and a contact member that comes into contact with liquid developer coated on the second coating member by the first coating member.

Further, in the developing device according to the first aspect, the contact member may be constituted of an elastic body.

Further, in the developing device according to the first aspect, the contact member may be a plate member and comes into contact with the second coating member at a surface portion.

Further, in the developing device according to the first aspect, the first coating member may have a groove that is a recessed portion.

Further, in the developing device according to the first aspect, the length of the contact member in the axial direction of the second coating member may be shorter than the axial length of the second coating member and longer than the axial length of a recessed portion forming region of the first coating member.

The developing device according to the first aspect may further include a bias applying section that forms a difference in electrical potential between the second coating member and the contact member.

According to a second aspect of the invention, an image forming apparatus includes: a liquid developer concentration adjusting section that adjusts the toner concentration of a liquid developer including toner and carrier liquid; a transportation section that transports liquid developer with the toner concentration adjusted at the liquid developer concentration adjusting section; a developing section including a developer storage portion that stores liquid developer transported by the transportation section, a first coating member that rotates and coats liquid developer stored in the developer storage portion, a second coating member that comes into contact with the first coating member and rotates in a direction opposite to that of the first coating member, a developer supporting body that comes into contact with the second coating member and rotates in the same direction as that of the second coating member, and a contact member that comes into contact with liquid developer coated on the second coating member by the first coating member; and a latent image supporting body that is developed by the developing section.

The image forming apparatus according to the second aspect may further include a driving control section that changes the rotary velocity of either the second coating member or the developer supporting body, and thus controls the peripheral velocity ratio of the second coating member and the developer supporting body.

BRIEF DESCRIPTION OF THE DRAWINGS

The invention will be described with reference to the accompanying drawings, wherein like numbers reference like elements.

DESCRIPTION OF EXEMPLARY EMBODIMENTS OF THE INVENTION

Figure 1:
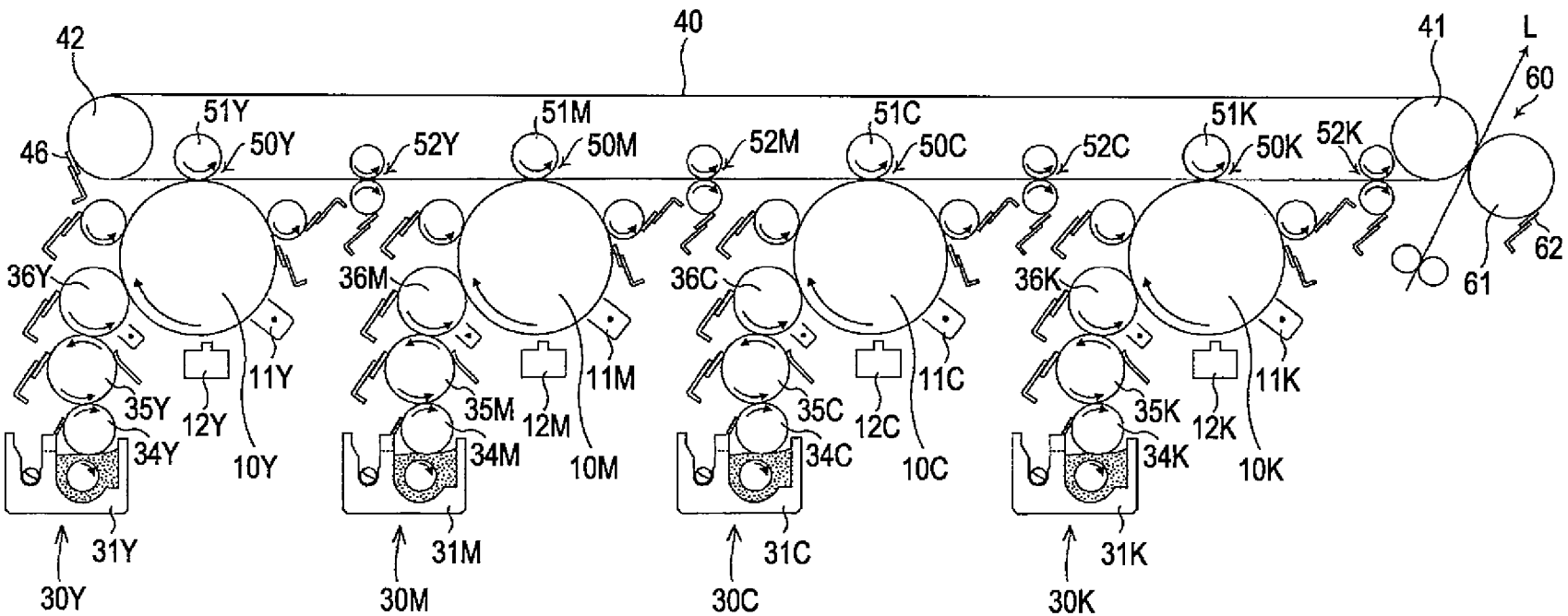
FIG. 1 is a cross-sectional view showing the main components of an image forming apparatus related to an embodiment of the invention.

Embodiments of the invention are now explained with reference to the drawings. FIG. 1 is a view showing the main components of an image forming apparatus related to an embodiment of the invention. With respect to an image forming section disposed at the central section of the image forming apparatus, four developing device 30Y, 30M, 30C, and 30K are disposed below the image forming section, and an intermediate transferring body 40 and a secondary transferring section (a secondary transferring unit 60) are disposed above the image forming section. The image forming section and the developing device 30Y, 30M, 30C, and 30K are explained below. However, since the configuration for each color is the same, the explanation will be made with alphabetic characters representing specific colors omitted. Further, although the image forming apparatus of this embodiment is capable of forming a full-color image by four colors of YMCK, the image forming apparatus is not limited to this embodiment, and may also be an image forming apparatus in which an appropriate color number including, for example, a single color is adopted.

The image forming section includes an image supporting body 10, a corona electrical charger 11, an exposure unit 12, and the like. The exposure unit 12 includes a semiconductor laser and an optical system including a polygon mirror, a F−θ lens, and the like and forms an electrostatic latent image by irradiating the electrified image supporting body 10 with modulated laser light on the basis of an input image signal.

The developing device 30 generally includes a developer vessel 31 that stores a liquid developer of each color, a supply roller 34 that coats liquid developer from the developer vessel 31 to an intermediate roller 35, and the like, and develops the electrostatic latent image formed on the image supporting body 10 by liquid developer of each color. The intermediate transferring body 40 is constituted by an endless belt or the like, mounted in a tensioned state on a driving roller 41 and a tension roller 42, and rotationally driven by the driving roller 41 while coming into contact with the image supporting body 10 in a primary transferring section 50. In the primary transferring section 50, the image supporting body 10 and a primary transferring backup roller 51 are disposed to face each other with the intermediate transferring body 40 interposed therebetween, and toner images of the respective colors on the developed image supporting bodies 10 are transferred in sequence in layers to the intermediate transferring body 40 with a contact position where each image supporting body 10 comes into contact with the intermediate transferring body 40 as a transfer position, so that a full-color toner image is formed.

In the secondary transferring section 60, a secondary transferring roller 61 is disposed to face the driving roller 41 with the intermediate transferring body 40 interposed therebetween. Further, a secondary transferring roller cleaning blade 62 is disposed in contact with the secondary transferring roller 61. Then, in a transfer position of the secondary transferring roller 61, a monochromatic toner image or a full-color toner image formed on the intermediate transferring body 40 is transferred to a recording medium such as a paper, a film, or cloth, which is transported in a sheet material transportation path L.

Then, on the downstream side of the sheet material transportation path L, a fixing unit (not shown) is disposed and fixes the monochromatic toner image or the full-color toner image, which has been transferred to the recording medium such as a paper, to the recording medium by fusing and bonding. Further, the tension roller 42 supports in a tensioned state the intermediate transferring body 40 along with the driving roller 41, and an intermediate transferring body cleaning blade 46 is disposed so as to be in contact with the intermediate transferring body 40 at a place where the intermediate transferring body 40 passes around the tension roller 42.

Figure 2:
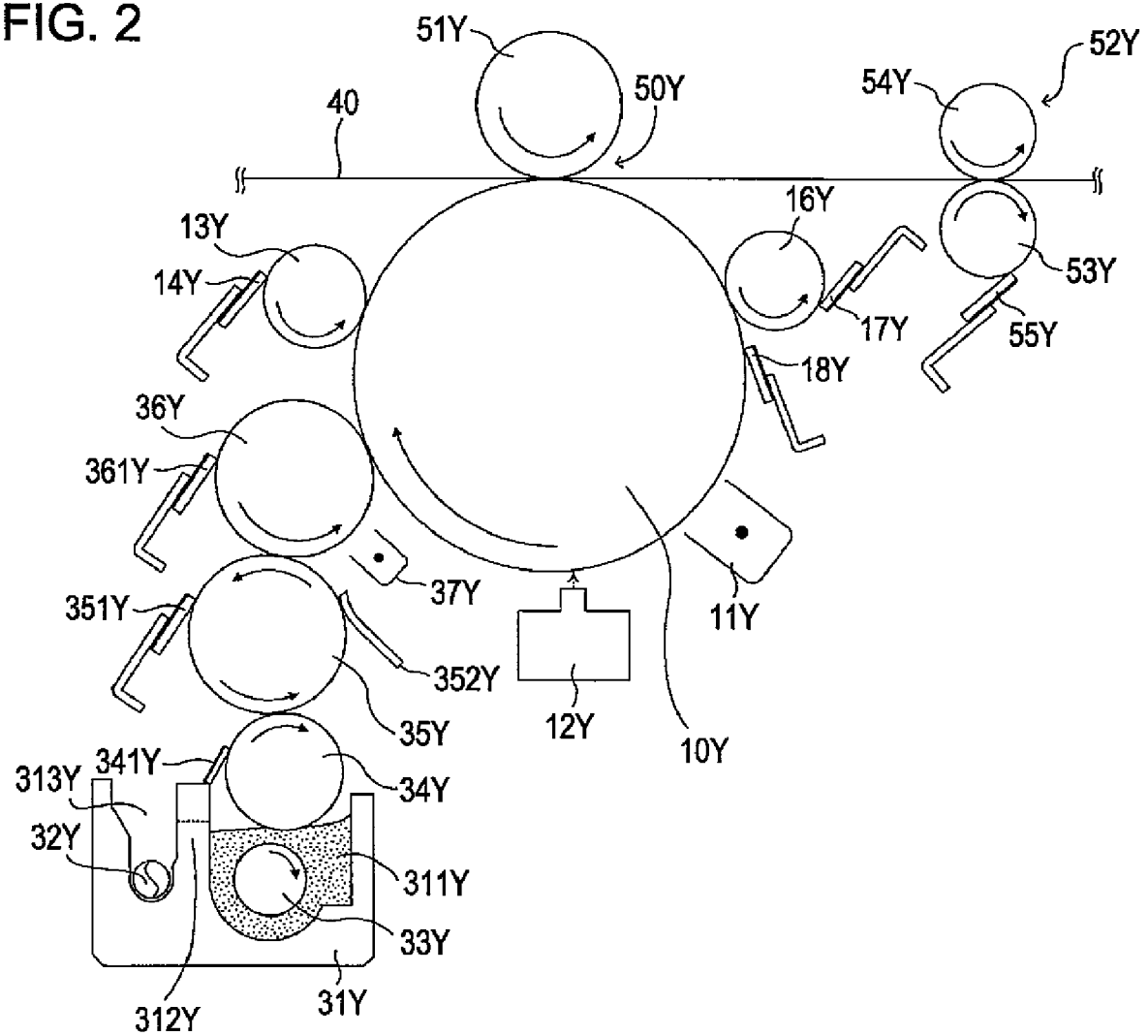
FIG. 2 is a cross-sectional view showing the main components of an image forming section and a developing device.

Next, the image forming section and the developing device related to the embodiment of the invention are explained. FIG. 2 is a cross-sectional view showing the main components of the image forming section and the developing device 30. Since the image forming sections and developing devices for the respective colors are the same, explanation is made based on the image forming section and developing device for yellow (Y) and alphabetic characters corresponding to the other colors are omitted.

On the periphery of the image supporting body 10, along the rotation direction thereof, an image supporting body cleaning roller 16, an image supporting body cleaning blade 18, the corona electrical charger 11, the exposure unit 12, a developing roller 36 of the developing device 30, and an image supporting body squeeze roller 13 are disposed. Further, an image supporting body cleaning roller cleaning blade 17 is disposed in contact with the image supporting body cleaning roller 16, and an image supporting body squeeze roller cleaning blade 14, which is an auxiliary component of the image supporting body squeeze roller 13, is disposed in contact with the image supporting body squeeze roller 13.

The primary transferring backup rollers 51 of the primary transferring sections 50 are disposed at the positions facing the image supporting bodies 10 along the intermediate transferring body 40, and on the downstream side of the primary transferring backup roller 51 along the moving direction of the intermediate transferring body 40, an intermediate transferring body squeeze device 52 is disposed which is composed of an intermediate transferring body squeeze roller 53, an intermediate transferring body squeeze backup roller 54, and an intermediate transferring body squeeze roller cleaning blade 55.

The image supporting body 10 is a photo conductor drum constituted of a cylindrical member that is broader in width than the developing roller 36 and has a photosensitive layer formed on the outer circumferential surface thereof, and rotates, for example, in the clockwise direction, as shown in FIG. 2. The photosensitive layer of the image supporting body 10 is constituted of an organic image supporting body, an amorphous silicon image supporting body, or the like. The corona electrical charger 11 is disposed on the upstream side of a nip portion of the image supporting body 10 and the developing roller 36 in the rotation direction of the image supporting body 10 and corona-charges the image supporting body 10 by application of a voltage from a power supply device. The exposure unit 12 irradiates the image supporting body 10 electrified by the corona electrical charger 11 with laser light at the downstream side of the corona electrical charger 11 in the rotation direction of the image supporting body 10, thereby forming an electrostatic latent image on the image supporting body 10.

The developing device 30 includes, as the main components, the developing roller 36, the intermediate roller 35, the supply roller 34, the developer vessel 31 which stores liquid developer in which toner is dispersed about 20% in ratio by weight in a carrier, and a toner compression corona generator 37 that performs compaction action on the developer. On the periphery of the developing roller 36, a cleaning blade 361, the intermediate roller 35, and the toner compression corona generator 37 are disposed. The intermediate roller 35 comes at its surface into contact with the developing roller 36 and the supply roller 34, and on the periphery of the intermediate roller 35, an intermediate roller cleaning blade 351 and a contact member 352 are disposed. A regulating blade 341 that adjusts the amount of liquid developer scooped up from a developer storage portion 311 is brought into contact with the supply roller 34. Further, since the intermediate roller 35 has the function of adjusting the amount of liquid developer by coming into contact with the supply roller 34, the regulating blade 341 may also be omitted.

In the liquid developer vessel 31, the developer storing portion 311 and a recovered liquid storage portion 313 are formed with a partition portion 312 as a wall portion interposed therebetween. A transporting screw 33 is accommodated in the developer storage portion 311 and a recovery screw 32 is accommodated in the recovered liquid storage portion 313. Also, the recovered liquid storage portion 313 is provided with the recovery screw 32 that recovers liquid developer that did not contribute to image forming.

A transportation portion that supplies liquid developer to the developer storage portion 311 is connected to the liquid developer vessel 31. The transportation portion scoops up liquid developer with a concentration adjusted at a liquid developer concentration adjusting section by a pump and transports liquid developer to the developer storage portion 311 through a supply port provided at the developer vessel 31. Liquid developer that is supplied to the developer storage portion 311 is not heretofore a commonly used volatile liquid developer of low concentration (1~2 wt %) and low viscosity using Isopar (brand mark: manufactured by Exxon Corp.) as a carrier and having volatility at a normal temperature, but rather is a liquid developer of high concentration and high viscosity (about 30~10000 mPa·S), in which a solid material of 1 μm average grain diameter having a coloring agent such as pigment dispersed in non-volatile resin at a normal temperature is added along with a dispersant to liquid solvent such as organic solvent, silicon oil, mineral oil, or edible oil and toner solid content concentration is about 20%.

The supply roller 34 that is a first coating member in the invention has the function of supplying liquid developer to the intermediate roller 35. The supply roller 34 is a roller which is a cylindrical member and is formed with a groove which is a recessed portion such as a helical groove helically engraved finely and uniformly in the surface so as to easily support liquid developer on the surface. Liquid developer scooped up by the recessed portion is precisely measured at the regulating blade 341 that comes into contact with the supply roller, and then supplied to the intermediate roller 35. In the operation of the device, as shown in FIG. 2, the transporting screw 33 rotates in the clockwise direction, thereby supplying liquid developer to the supply roller 34, and the supply roller 34 rotates in the clockwise direction, thereby coating liquid developer on the intermediate roller 35.

The regulating blade 341 is a metallic blade or an elastic blade having a surface covered with an elastic body. In this embodiment, the regulating blade is constituted of a rubber portion made of urethane rubber or the like and being brought into contact with the surface of the supply roller 34, and a plate made of metal or the like and supporting the rubber portion. The regulating blade regulates and adjusts the film thickness and the amount of liquid developer supported and transported by the supply roller 34, thereby adjusting the amount of liquid developer that is supplied to the intermediate roller 35. A regulating roller may be used in place of regulating blade 341. In this embodiment, since the intermediate roller 35 has the function of adjusting the amount of liquid developer as in the regulating blade 341 or the regulating roller, the regulating blade 341 or a regulating roller may not be provided.

The developing roller 36, which is a developer supporting body in the invention, is a cylindrical member and rotates in the counter-clockwise direction about a rotary shaft, as shown in FIG. 2. The developing roller 36 is constituted by an inner core made of metal such as iron and an elastic layer, such as a tube of polyurethane rubber, silicon rubber, NBR, PFA, or the like, provided on the outer circumferential portion of the core. The developing roller cleaning blade 361 is constituted of rubber or the like that is brought into contact with the surface of the developing roller 36, and is disposed on the downstream side of a developing nip portion where the developing roller 36 comes into contact with the image supporting body 10, in the rotation direction of the developing roller 36, so as to scrape off and remove liquid developer remaining on the developing roller 36.

The intermediate roller 35, which is a second coating member in the invention, is a cylindrical member and rotates in the counter-clockwise direction, similarly to the developing roller 36, about a rotary shaft, as shown in FIG. 2, thereby coming into counter-contact with the developing roller 36. The intermediate roller 35 is constituted by an inner core made of metal and an elastic layer provided on the outer circumferential portion of the core, similarly to the developing roller 36. The contact member 352 constituted of an elastic body such as PET film, urethane resin, or polyimide resin comes into contact with the outer circumference of the intermediate roller 35 on the upstream side of a contact position where the intermediate roller 35 comes into contact with the developing roller 36. Due to the contact member 352, it becomes possible to eliminate or suppress a transfer pattern formed by the helical groove 342 as a groove which is a recessed portion.

The intermediate roller cleaning blade 351 is provided on the downstream side of the contact position where the intermediate roller 35 comes into contact with the developing roller 36, and scrapes off liquid developer that has not been supplied to the developing roller 36, thereby recovering it to the recovered liquid storage portion 313.

The toner compression corona generator 37 is an electric field applying section that increases the electrifying bias of the surface of the developing roller 36, and liquid developer transported by the developing roller 36 is applied with an electric field at a position adjacent to the toner compression corona generator 37, so that toner compression is performed. A compaction roller or the like may also be used as the electric field applying section for the toner compression, in place of the corona discharging of a corona discharger. A compaction roller is a cylindrical member, has a structure having an electrically conductive resin layer or rubber layer provided on the surface of a metallic roller base material, and preferably rotates in the clockwise direction opposite to the rotation direction of, for example, the developing roller 36.

The toner-compressed liquid developer supported on the developing roller 36 is developed corresponding to the electrostatic latent image of the image supporting body 10 by a desired electric field in the developing nip portion where the developing roller 36 comes into contact with the image supporting body 10. Then, developer that did not contribute to the development is scraped off by the developing roller cleaning blade 361 and drops into the recovered liquid storage portion 313 of the developer vessel 31. The dropped developer is adjusted in concentration at the liquid developer concentration adjusting section, and supplied to the developer storage portion 311 again, thereby being reused.

An image supporting body squeeze device, which is disposed on the upstream side of the primary transfer position, is disposed on the downstream side of the developing roller 36 to face the image supporting body 10 and recovers surplus developer of the developed toner image on the image supporting body 10. The image supporting body squeeze device is constituted by the image supporting body squeeze roller 13, which is constituted of an elastic roller member having a surface covered with an elastic body and rotating in sliding-contact with the image supporting body 10, and the cleaning blade 14 that comes into sliding-contact with and presses the image supporting body squeeze roller 13, thereby cleaning the surface of the image supporting body squeeze roller, and has the function of recovering a surplus carrier from the developed developer on the image supporting body 10, thereby increasing a toner particle proportion in a visible image. As for the image supporting body squeeze device before the primary transfer, in this embodiment, a single image supporting body squeeze roller 13 is provided. However, a plurality of image supporting body squeeze rollers may also be provided. In this case, a configuration may also be made such that the image supporting body squeeze rollers to be brought into contact with or separated from are changed over according to a liquid developer state or the like.

In the primary transferring section 50, the developed developer image on the image supporting body 10 is transferred to the intermediate transferring body 40 by the primary transferring backup roller 51. Here, since the image supporting body 10 and the intermediate transferring body 40 are moved at the same speed, a drive load due to rotation and movement is reduced and the disturbance action of the image supporting body 10 on the toner image of the visible image is also suppressed.

An image supporting body cleaning device is disposed on the downstream side of the primary transferring section 50 to face the image supporting body 10, thereby cleaning liquid developer left after transfer or un-transferred liquid developer on the image supporting body 10. The image supporting body cleaning roller 16 is applied with such a bias voltage as to attract the toner particles in liquid developer. Therefore, the developer recovered by the image supporting body cleaning roller 16 is a solid-rich liquid developer with many toner particles contained. The solid-rich liquid developer recovered by the image supporting body cleaning roller 16 is scraped off by the image supporting body cleaning roller cleaning blade 17 that comes into contact with the image supporting body cleaning roller 16, and then drops vertically.

The intermediate transferring body squeeze device 52 is constituted by the intermediate transferring body squeeze roller 53 composed of an elastic roller member that has a surface covered with an elastic body and that rotates in sliding-contact with the intermediate transferring body 40, the intermediate transferring body squeeze backup roller 54 disposed to face the intermediate transferring body squeeze roller 53 with the intermediate transferring body 40 interposed therebetween, and the cleaning blade 55 that comes into sliding-contact with and presses the intermediate transferring body squeeze roller 53, thereby cleaning the surface of the intermediate transferring body squeeze roller. Also, the intermediate transferring body squeeze device 52 has the function of recovering a surplus carrier and the like from the developer primarily transferred to the intermediate transferring body 40.

Figure 3:
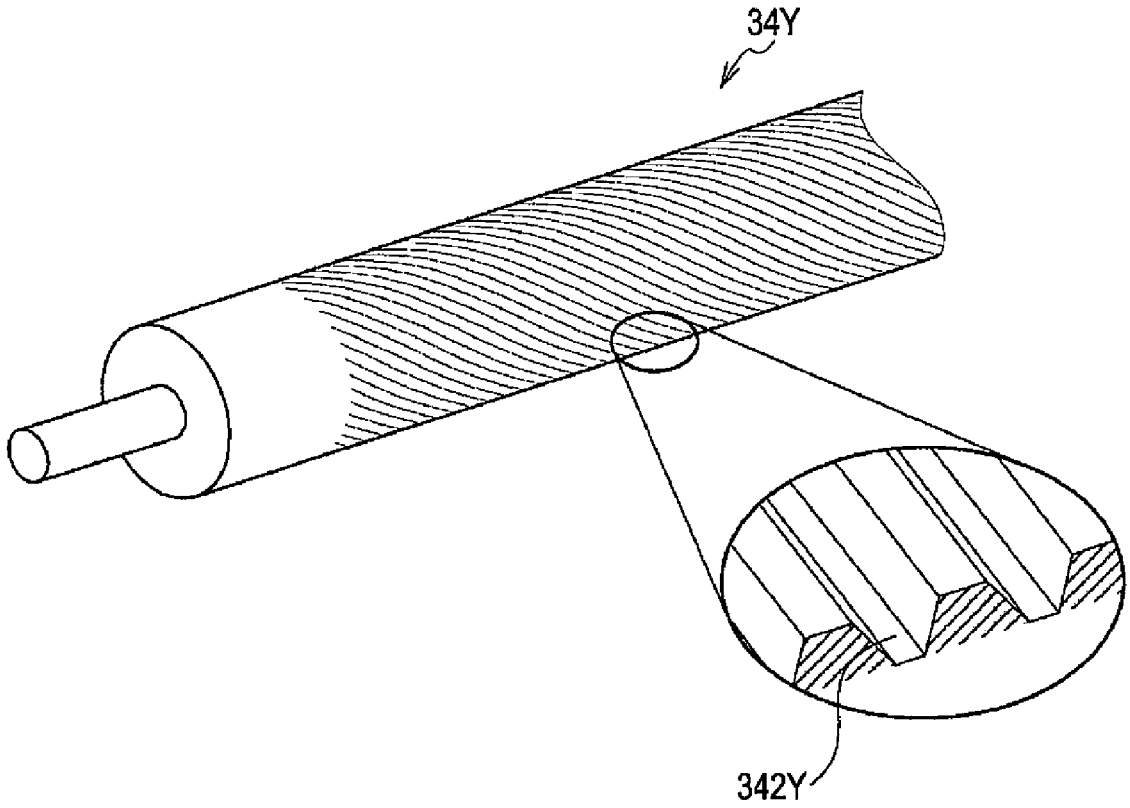
FIG. 3 is a perspective view of a supply roller related to the embodiment of the invention.

The developing device and the image forming apparatus related to the embodiment of the invention have been explained above. Next, the supply roller 34, which is the first coating member used in the developing device and the image forming apparatus according to the invention, is explained. FIG. 3 shows a perspective view of the supply roller 34 used in the invention and an enlarged view of a portion thereof. The supply roller 34 in the invention has a recessed portion pattern forming region provided at the central portion of the surface thereof, as shown by the oblique lines in the drawing. The recessed portion pattern forming region is intended for the precise measurement of liquid developer and the improvement of supply efficiency and in this embodiment, adopts a helical groove 342. However, it is not limited to this embodiment, and a variety of shapes and arrays such as a pyramid-shaped recessed portion shape and a lattice recessed portion array, for example, may also be adopted. When the supply roller 34 rotates, the recessed portion-formed pattern scoops up liquid developer and supplies it to the intermediate roller 35.

Figure 4B:
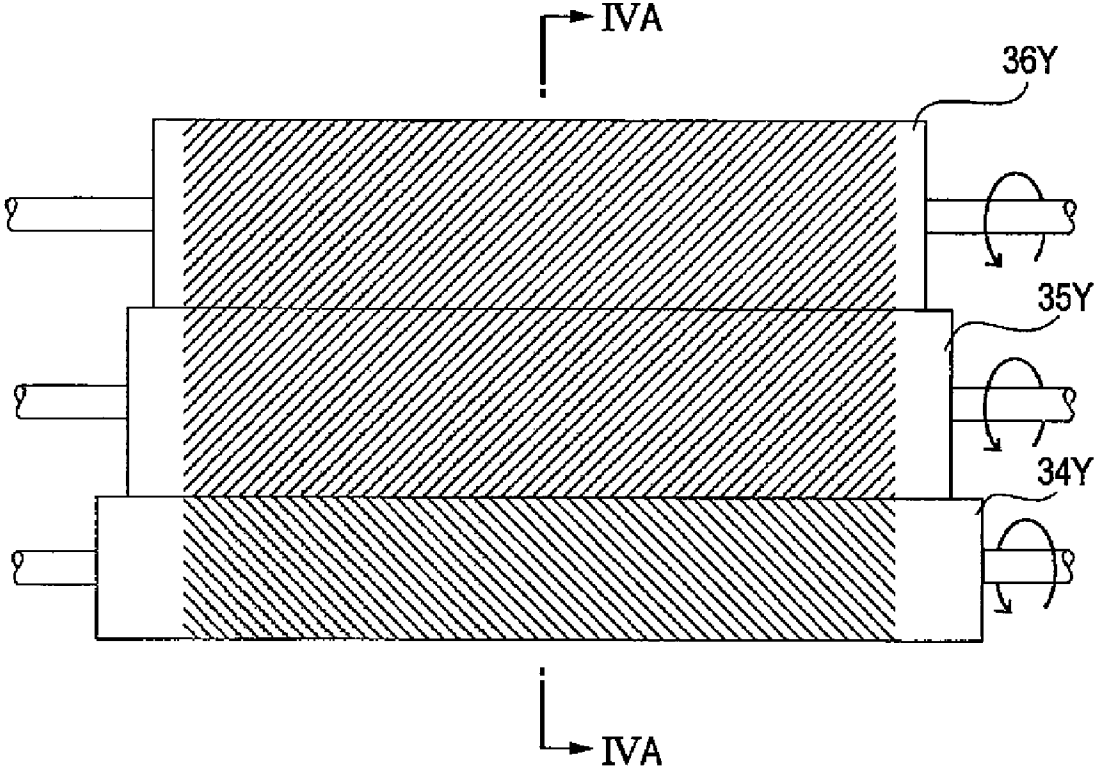
FIGS. 4A and 4B are a cross-sectional view of the developing device related to the embodiment of the invention and a view showing the aspect of a transfer pattern.
Figure 4A:
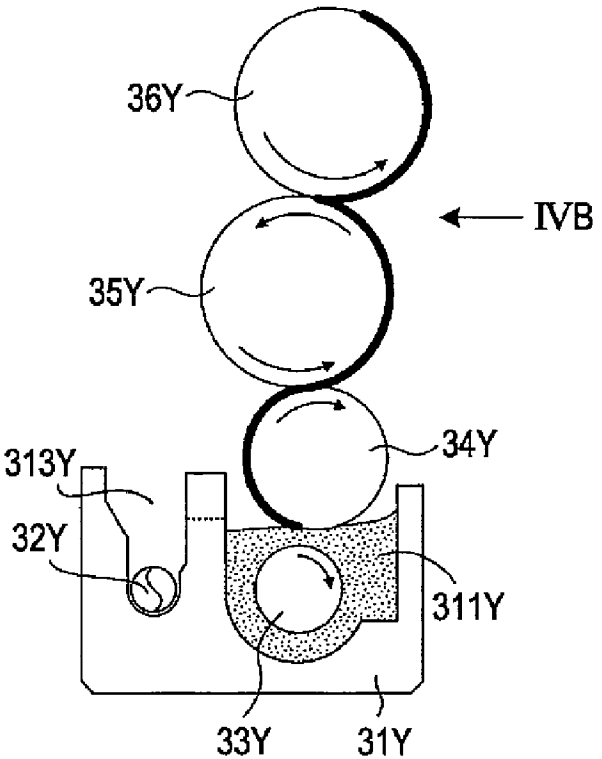
Figure 5A:
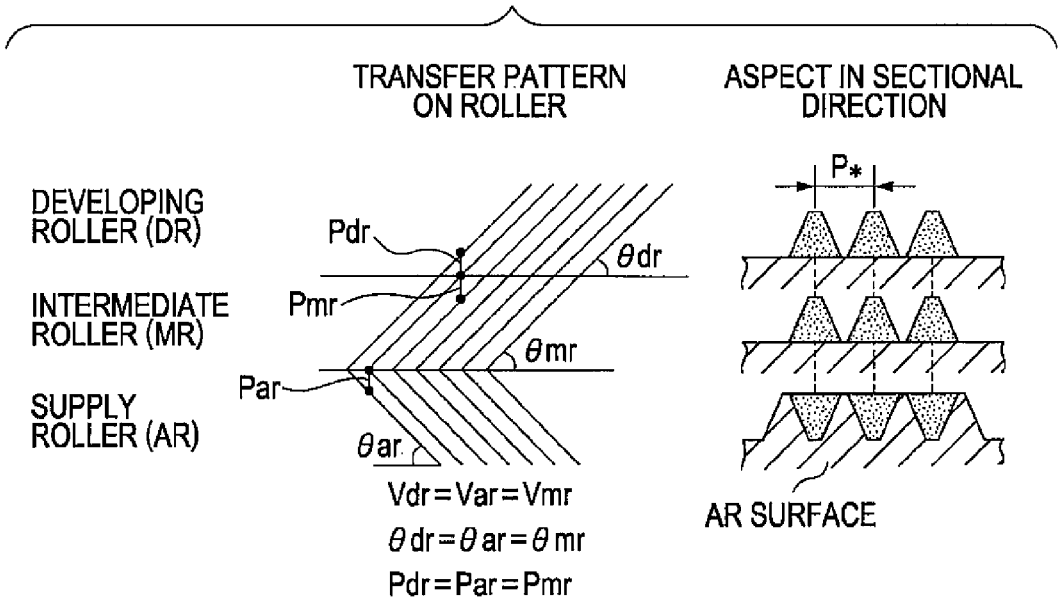
FIGS. 5A and 5B are views explaining the transfer pattern by the supply roller.
Figure 5B:
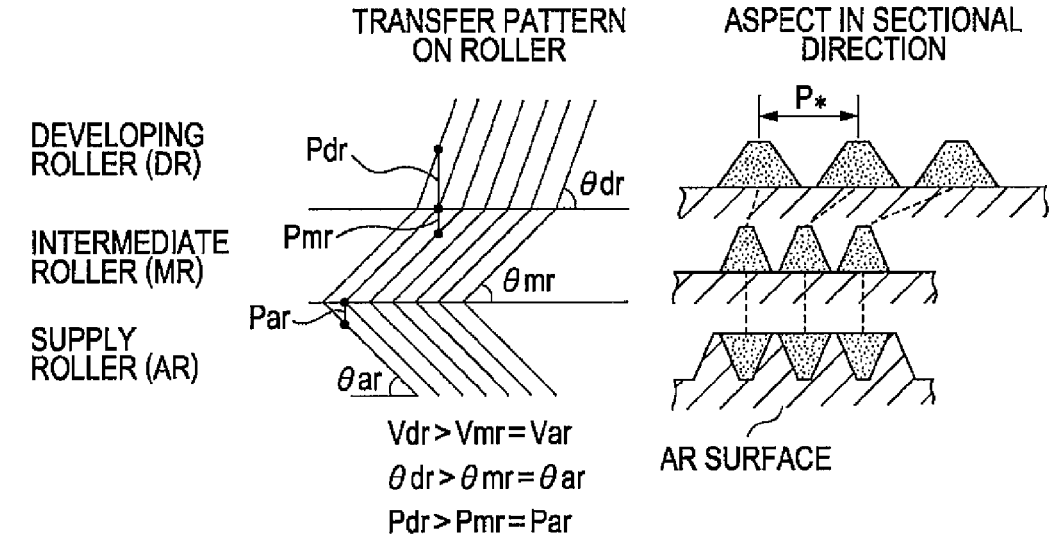

Next, the aspect of the transfer pattern of liquid developer by a recessed portion pattern formed in the supply roller 34 is explained with reference to FIGS. 4A, 4B, 5A and 5B. FIG. 4A is a cross-sectional view of the developing device and FIG. 4B is a view showing the aspect of the transfer pattern in each roller. FIGS. 5A and 5B are views explaining the transfer pattern by the supply roller 34.

FIG. 4A is a cross-sectional view taken along line IVA-IVA of FIG. 4B, and the thick lines described on the surfaces of the supply roller 34, the intermediate roller 35, and the developing roller 36 show an aspect where liquid developer scooped up from the developer storage portion 311 is transferred. The surrounding configuration of each roller is omitted. First, liquid developer stored in the developer storage portion 311 is scooped up by the supply roller 34 which rotates in the clockwise direction, and supplied to the intermediate roller 35 which rotates in the counter-clockwise direction and comes into contact with the supply roller 34 in the forward direction. Liquid developer supplied to the intermediate roller 35 is supplied to the developing roller 36, which rotates in the counter-clockwise direction, and comes into contact with the intermediate roller 35 in the reverse direction. Liquid developer supplied to the developing roller 36 is then supplied to the image supporting body 10 (not shown in this drawing), thereby forming an image.

Since the helical groove 342 explained in FIG. 3 is formed in the surface of the supply roller 34 of this embodiment, liquid developer scooped up by the supply roller 34 forms the transfer patterns of liquid developer on the surfaces of the intermediate roller 35 and the developing roller 36. Aspects of the transfer patterns are shown in FIG. 4B. FIG. 4B is a view of FIG. 4A from the direction indicated by arrow IVB, and shows aspects of, the transfer pattern in each roller. As shown in FIG. 4B, in a case where the helical groove 342 formed in the supply roller 34 is a diagonally right down pattern, the transfer patterns of liquid developer on the surfaces of the intermediate roller 35 and the developing roller 36 become the same as those shown in the drawing. Specifically, a diagonally right up transfer pattern is formed on the surface of the intermediate roller 35 that comes into contact with the supply roller 34 in the forwardly direction, and a diagonally right up transfer pattern is also formed on the surface of the developing roller 36 that comes into contact with the intermediate roller 35 in the reverse direction.

FIGS. 5A and 5B are views explaining the relationship between the aspect of the transfer pattern in each roller and the relative velocity of each roller. FIG. 5A shows the transfer pattern in each roller in a case where the rotary peripheral velocity Vdr of the developing roller 36, the rotary peripheral velocity Vmr of the intermediate roller 35, and the rotary peripheral velocity Var of the supply roller 34 are the same. Here, the term "rotary peripheral velocity" means a tangential velocity of the surface of each roller at the time of rotation. As explained in FIGS. 4A and 4B, as to the transfer pattern that is formed on each roller, in this embodiment in which the recessed portion pattern is composed of a helical groove, the transfer pattern shown by oblique lines in the drawing is formed.

Assuming that the acute angle that the helical groove 342 of the supply roller 34 makes with the axial direction is θar, the acute angle that the transfer pattern of the intermediate roller 35 makes with the axial direction is θmr, and the acute angle that the transfer pattern of the developing roller 36 makes with the axial direction is θdr, in a case where the rotary peripheral velocities of the respective rollers are the same, the acute angles that the transfer patterns of the respective rollers make with their axial directions are the same and the relationship of θar=θmr=θdr is established. As to the distance (pitch distance P*) between the adjacent oblique lines in a direction perpendicular to the axial direction, the pitch distance Par in the supply roller 34, the pitch distance Pmr in the intermediate roller 35, and the pitch distance Pdr in the developing roller 36 all become the same. In this manner, in a case where the rotary peripheral velocities of the respective rollers are the same, the pitch distances of the transfer patterns become the same as the pitch distance of the helical groove 342 formed in the supply roller 34. Since the pitch distance Par of the helical groove 342 is usually set to be a distance considered such that the film thickness of liquid developer formed on the developing roller 36 does not become uneven, in a case where the pitch distance Par of the supply roller 34 and the pitch distance Pdr of the developing roller 36 are the same, no trouble occurs in the film thickness of liquid developer on the developing roller 36.

Next, a case where the rotary peripheral velocity Vdr of the developing roller 36 is set to be faster than the rotary peripheral velocity Vmr of the intermediate roller 35 and the rotary peripheral velocity Var of the supply roller 34 (Vdr>Vmr=Var) is explained with reference to FIG. 5B. In the case of thinning the film thickness of liquid developer that is formed on the surface of the developing roller 36, making the rotary peripheral velocity of the roller (in this embodiment, the intermediate roller 35) that comes into contact with the developing roller 36, slower than the rotary peripheral velocity Vdr of the developing roller 36 is done. This leads to the delay of liquid developer due to a rotary peripheral velocity difference. FIG. 5B shows the transfer pattern on each roller in this case.

The transfer pattern on the surface of the intermediate roller 35 is the same as the case of FIG. 5A, and the acute angle θmr that the transfer pattern on the intermediate roller 35 makes with the axial direction is the same as the acute angle θar that the helical groove 342 of the supply roller 34 makes with the axial direction. Also, the pitch distance Par in the supply roller 34 is the same as the pitch distance Pmr of the intermediate roller 35.

On the other hand, the transfer pattern formed on the surface of the developing roller 36 with the rotary peripheral velocity set to be faster than that of the intermediate roller 35, becomes a state of being stood up in comparison with the transfer pattern on the intermediate roller 35, as shown in the drawing. Specifically, the acute angle θdr that the transfer pattern on the developing roller 36 makes with the axial direction becomes larger than the other angles and the pitch distance Pdr is enlarged in comparison with the others. The enlargement of the pitch distance Pdr causes unevenness of the film thickness of liquid developer on the developing roller 36.

The aspect of the transfer pattern formation on each roller in a case where as the recessed portion pattern, the helical groove 342 is formed in the supply roller 34 has been explained above. However, the phenomenon of unevenness of the film thickness based on the difference between the rotary peripheral velocities of the supply roller 34 and the intermediate roller 35 is also confirmed in cases where other shapes or arrays are used for the recessed portion pattern. The invention is characterized in that the contact member 352 is brought into contact with liquid developer coated on the surface of the intermediate roller 35 in order to solve the unevenness of the film thickness of liquid developer due to the transfer pattern. Further, according to the invention, improvement in the evenness of liquid developer film thickness can also be realized in a case where the rotary peripheral velocities of the respective rollers are set to be the same, as in FIG. 5A.

Figure 6:
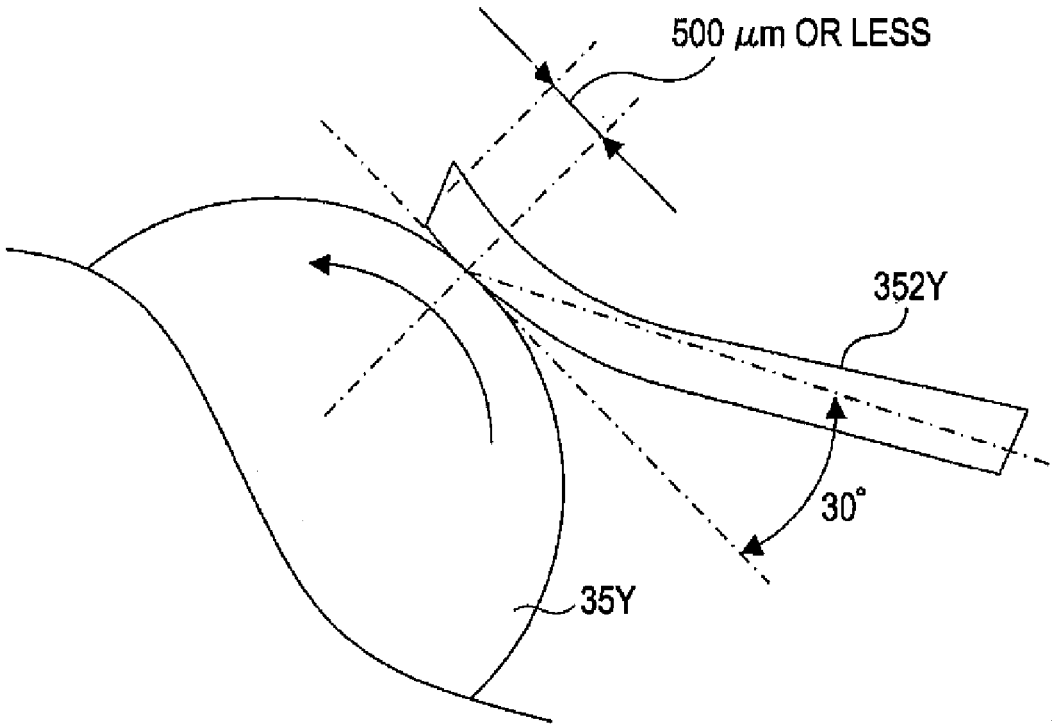
FIG. 6 is a view showing a contact aspect in which a contact member comes into contact with an intermediate roller.
Figure 7:
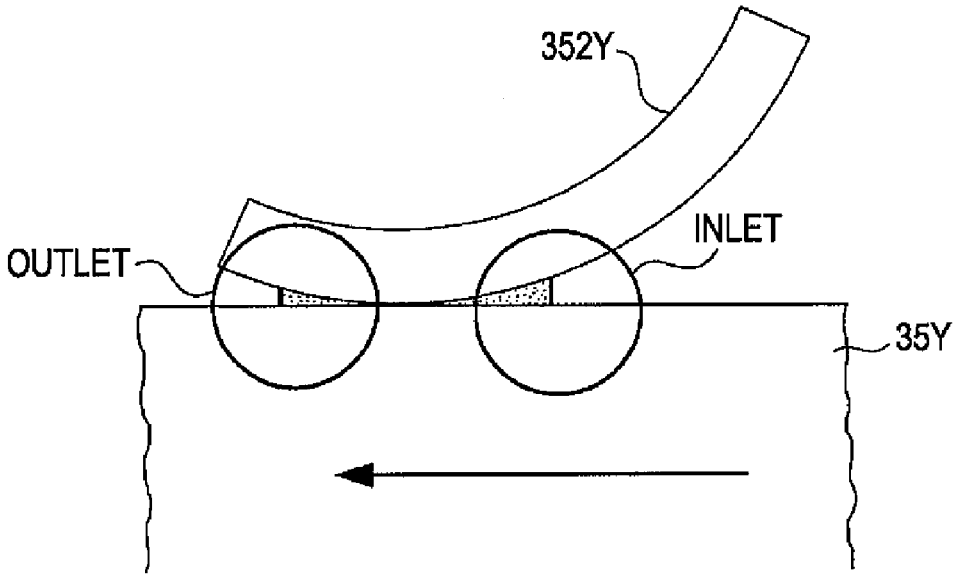
FIG. 7 is a view showing a meniscus formed between the intermediate roller and the contact member.
Figure 8:
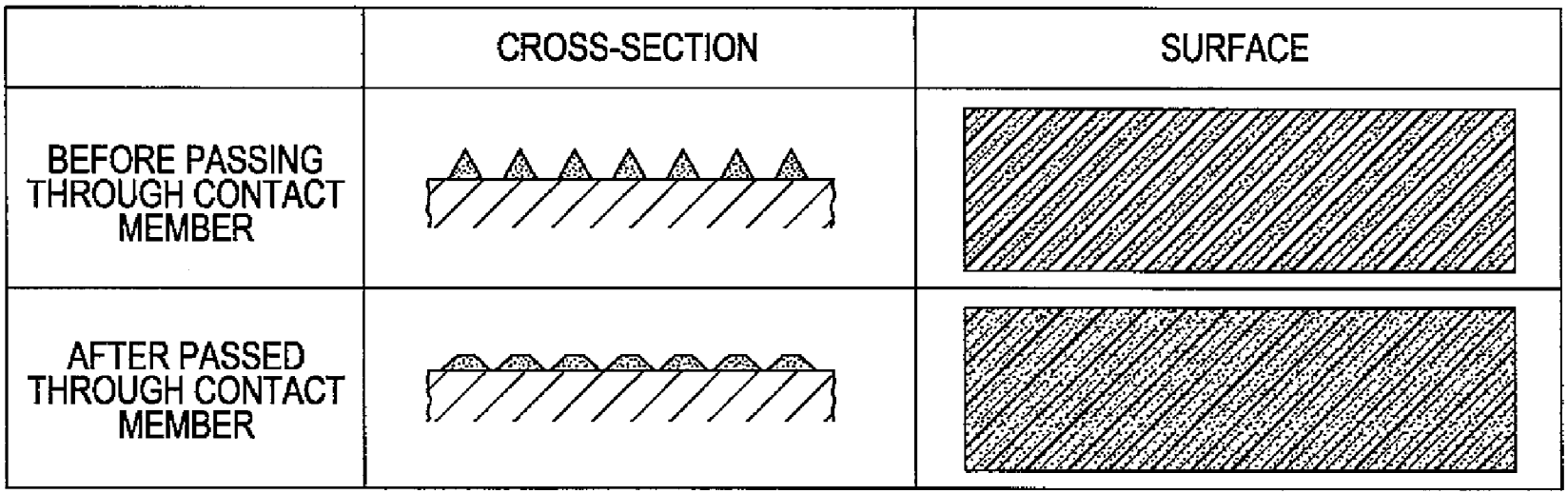
FIG. 8 is a view showing the aspect of a liquid developer on the surface of the intermediate roller.
Figure 9:
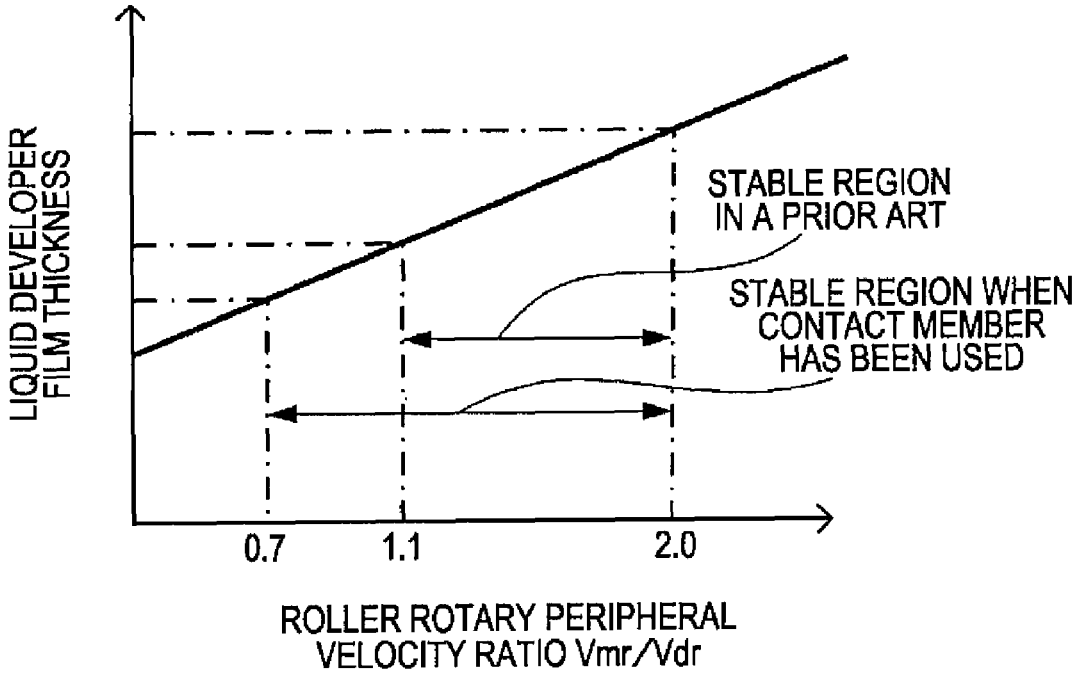
FIG. 9 is a graph showing the relationship between a roller rotary peripheral velocity ratio Vmr/Vdr and a liquid developer film thickness.

Next, the contact member 352 is explained in more detail with reference to FIGS. 6-9. FIG. 6 is a view showing a contact aspect in which the contact member 352 comes into contact with the intermediate roller 35, and FIG. 7 is a view showing a meniscus formed between the intermediate roller 35 and the contact member 352. FIG. 8 is a view showing the aspect of liquid developer in the surface of the intermediate roller 35, and FIG. 9 is a graph showing the relationship between a roller rotary peripheral velocity ratio Vmr/Vdr and the film thickness of liquid developer.

As explained with reference to FIGS. 1 and 2, the contact member 352 comes into contact with the intermediate roller 35 after liquid developer is coated on the intermediate roller 35 by the supply roller 34 and before liquid developer on the intermediate roller 35 is coated on the developing roller 36. FIG. 6 is a view showing the aspect of the contact, and FIG. 7 is a view showing the meniscus of liquid developer formed between the intermediate roller 35 and the contact member 352.

The contact member 352 is made of a material such as PET, urethane resin, or polyimide resin and comes into contact with the intermediate roller 35 in a forward direction. In this embodiment, the contact member 352 is constituted of a film with PET as a material.

FIG. 7 shows the aspect of the formation of a liquid developer meniscus due to the surface tension of the intermediate roller 35 and the contact member 352. In the drawing, the surface of the intermediate roller 35 is regarded as advancing from right to left and the right and the left of the contact position of the contact member 352 with the intermediate roller 35 become an inlet and an outlet of liquid developer, respectively. A meniscus where liquid developer stays between the inlet and the outlet is formed. The amount of the meniscus varies according to factors such as the rotary peripheral velocity of the intermediate roller 35, the viscosity of liquid developer, the contact pressure and the contact angle of the contact member 352, and the like.

In a case where the contact member 352 is constituted of a plate member and the leading end portion thereof is brought into contact with the intermediate roller 35, the transfer pattern formed by the supply roller 34 is cut by rubbing, so that the passage capability of liquid developer in the contact portion worsens. Also, in a case where the leading end shape of the contact member 352 is roughened, a stripe is formed in liquid developer which has passed the contact member 352, thereby causing the deterioration of an image.

Therefore, in this embodiment, the leading end portion of the contact member 352 is set to be longer than the contact portion where the contact member 352 comes into contact with the intermediate roller 35. That is, a configuration is made such that the contact member 352 comes into contact with the intermediate roller 35 not at the leading end portion, but at the surface portion of the contact member 352. Accordingly, a meniscus is formed also in the vicinity of the outlet of the contact portion, so that liquid developer is also supplied to the recessed portion of the transfer pattern, whereby it becomes possible to make uniform the film thickness of liquid developer. In this embodiment, it could be confirmed that an even liquid developer surface is obtained by setting the projecting amount of the leading end portion to be 500 μm or less.

On the other hand, if the contact pressure of the contact member 352 is set to be large, the passage of liquid developer is regulated, so that the value correctly measured at the supply roller 34 is deteriorated. Therefore, the contact pressure of the contact member 352 is necessary to be a value which does not restrict the passage of liquid developer and at the same time, is sufficient to uniformize the transfer pattern. Specifically, it is preferable to set the contact pressure such that the meniscus of liquid developer at the inlet of the contact portion of the contact member 352 with the intermediate roller 35 does not continuously increase at the time of the rotation of the intermediate roller 35. If the meniscus of liquid developer at the inlet of the contact portion continuously increases, liquid developer correctly measured at the helical groove 342 is regulated. Also, liquid developer continuously increased at the inlet of the contact portion leads to liquid dripping, thereby causing interior contamination of the device.

In this manner, the contact pressure of the contact member 352 must not be so large as to continuously increase the meniscus and needs to be adjusted to be so large as to eliminate the unevenness of the film thickness due to the transfer pattern. In addition, since the amount of the meniscus varies according to various factors such as the kind of liquid developer, the interior temperature of the device, and the rotary peripheral velocity of the intermediate roller 35, a mechanical adjustment mechanism is preferably provided at the contact member 352 so as to be able to adjust the contact pressure to the intermediate roller 35. In a case where the contact member 352 is constituted by a plate member as shown in FIG. 6, a configuration is made such that the contact pressure or the contact angle can be adjusted by pivotally supporting the other end of the contact portion of the contact member 352, or by a contact adjusting support portion that moves the contact member 352 itself toward and away from the intermediate roller 35. Also, in the image forming apparatus, in a case where the rotary peripheral velocity of the intermediate roller 35 is variably controlled by various settings of resolution and the like, the adjustment mechanism of the contact member 352 may also be automatically adjusted on the basis of various settings. It is also conceivable to automatically adjust the adjustment mechanism in accordance with a change in environment, such as temperature. Further, it is also conceivable to provide a sensor for detecting the amount of the meniscus and automatically adjust the adjustment mechanism by the detected meniscus amount.

Since the contact member 352 is used with its leading end curved as shown in the drawing, if the contact angle is large, a load on the contact member 352 is also increased, whereby permanent deformation due to flexure may occur. If the contact member 352 is deformed, an expecting contact pressure cannot be obtained, so that the original function of the contact member 352 is not obtained. Therefore, the contact angle of the contact member 352 with the intermediate roller 35 id preferably set to be 30° or less.

By bringing the contact member 352 into contact with the intermediate roller 35 on the contact conditions of the contact pressure and the contact angle as described above, it becomes possible to eliminate the transfer pattern and realize the uniform liquid developer film thickness. FIG. 8 shows aspects of the cross-section and the surface of liquid developer before passing through the contact member 352 and after being passed through the contact member 352. Liquid developer on the surface of the intermediate roller 35 before passing through the contact member 352 forms the transfer pattern of a distinguished oblique line shape by the helical groove 342. In the cross-section thereof, mountain-shaped liquid developers are arranged at a given pitch distance. If a gap where liquid developer is not coated is large, generation of unevenness of the liquid developer film thickness is caused.

On the other hand, in the cross-section after being passed through the contact member 352, the height of the mountain-shaped liquid developer is regulated, so that the developer becomes a state where it has been crushed in a lateral direction, thereby filling up a gap where liquid developer is not coated. Accordingly, the transfer pattern of liquid developer on the surface of the intermediate roller 35 is reduced in comparison with that before passing through the contact member, as shown in the drawing. Here, although the embodiment to reduce the transfer pattern was explained, preferably, the contact pressure is set such that the film thickness of liquid developer becomes uniform also in any portion, that is, the transfer pattern is completely eliminated.

In order to compare the film thickness of liquid developer formed on the developing roller 36 in a case where the contact member 352 has been used, with the film thickness of liquid developer in a case where the contact member 352 has not been used as in the past, FIG. 9 is a graph showing the relationship between a roller rotary peripheral velocity ratio Vmr/Vdr and the liquid developer film thickness. The film thickness of liquid developer formed on the developing roller 36 can be controlled by the difference between the rotary peripheral velocities of the developing roller 36 and the intermediate roller 35. The film thickness of the developer can be formed thinly by making the rotary peripheral velocity of the developing roller 36 faster than the rotary peripheral velocity of the intermediate roller 35, and the film thickness of liquid developer can be formed thickly by making the rotary peripheral velocity of the developing roller 36 slower than the rotary peripheral velocity of the intermediate roller 35.

In the case of thinning the film thickness, in the past, the lower limit of the roller rotary peripheral velocity ratio Vmr/Vdr was about 1.1 because of generation of unevenness of liquid developer due to the enlargement of the pitch distance Pdr as explained in FIG. 5B. However, according to this embodiment, in which the contact member 352 is used, it becomes possible to lower the lower limit to about 0.7. In this manner, it becomes possible to broaden the control range of the film thickness of liquid developer. In particular, since a thinner film thickness is realized in comparison with that in the past, an image of higher resolution can be formed.

A change in the roller rotary peripheral velocity ratio Vmr/Vdr as described above is realized by controlling the rotary velocity of at least one of the intermediate roller 35 and the developing roller 36 by a driving control section. At that time, the driving control section may also determine the rotary velocity of each roller on the basis of a variety of information such as image density information or resolution information, which is input.

Figure 10:
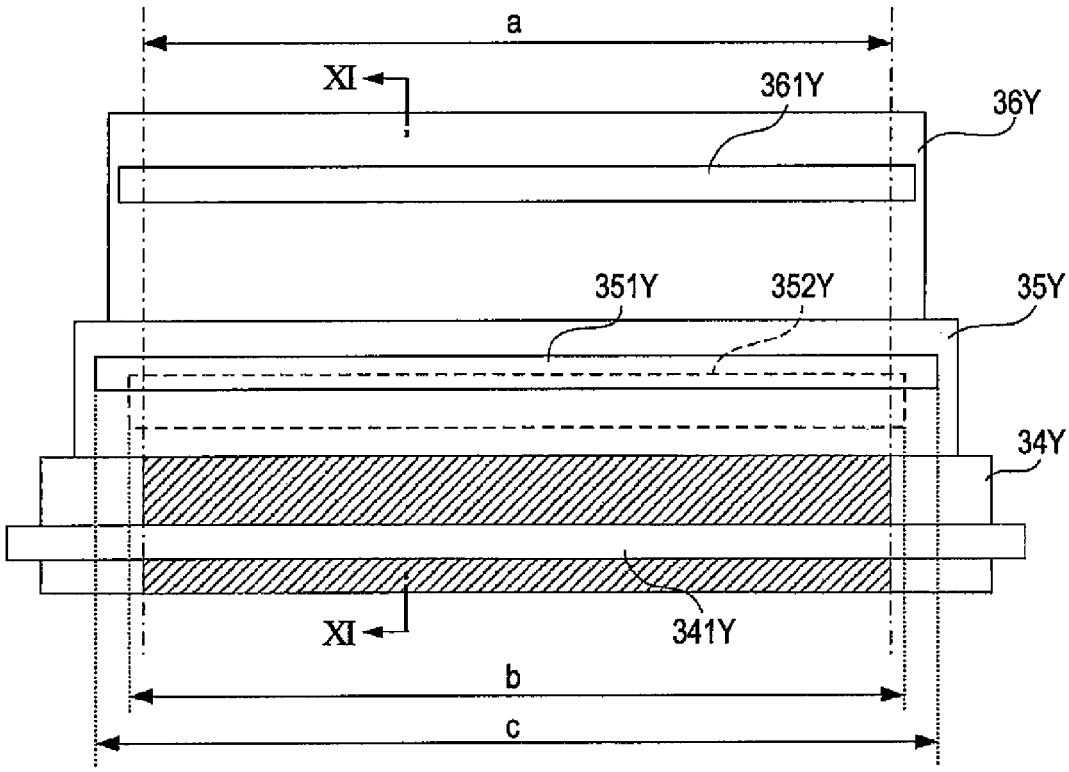
FIG. 10 is a front view of each roller and the surrounding configuration.
Figure 11:
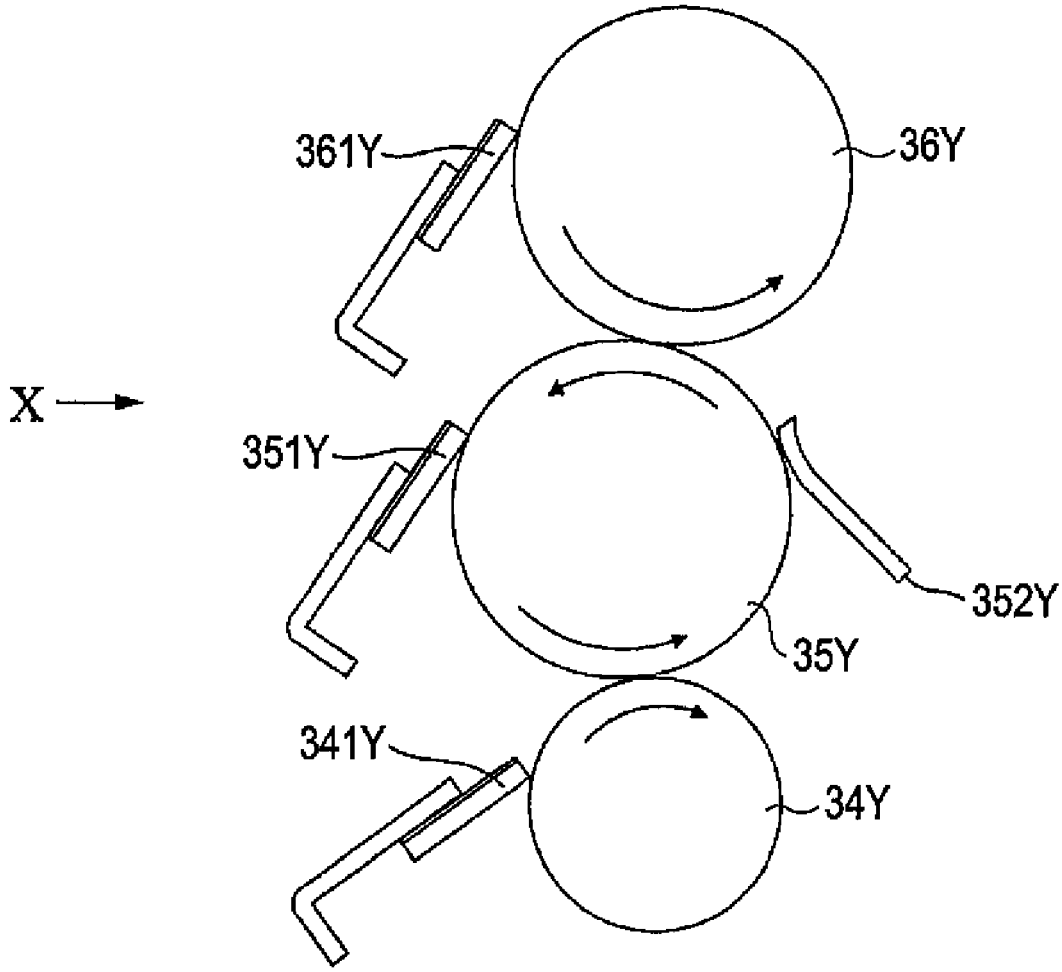
FIG. 11 is a cross-sectional view of each roller and the surrounding configuration.

Next, the relationship of length between each roller and the configuration located around each roller is explained using FIGS. 10 and 11. FIG. 10 shows a front view of each roller and the surrounding configuration, and FIG. 11 shows a cross-sectional view of each roller and the surrounding configuration. The front view of FIG. 10 is a diagram as viewed from the direction of an arrow X in the cross-sectional view of FIG. 11, and the cross-sectional view of FIG. 11 is a diagram taken along line XI-XI in the front view of FIG. 10.

In FIG. 10, in the central portion of the supply roller 34, a recessed portion pattern forming region by the helical groove 342 is formed. The axial length a (width a) of the recessed portion pattern forming region is set to be the same as the width of the coating region of liquid developer. The regulating blade 341 comes into contact with the supply roller 34 over the entire width of the recessed portion pattern forming region, thereby precisely measuring liquid developer. The regulating blade 341 is longer than the supply roller 34, thereby preventing extra liquid developer attached to the end portions of the supply roller 34 from being coated on the intermediate roller 35. Also, in this embodiment in which liquid developer is indirectly coated on the developing roller 36 through the intermediate roller 35, since the intermediate roller 35 bears the function of the regulating blade 341, the regulating blade 341 may be omitted.

The transfer pattern of liquid developer coated on the intermediate roller 35 is eliminated by the contact member 352. The axial length of the intermediate roller 35 is set to be shorter than the axial length of the supply roller 34 and longer than the width a of the recessed portion pattern forming region. The length b (width b) of the contact member 352 in the axial direction of the intermediate roller is set to be longer than the width a of the recessed portion pattern forming region. Liquid developer that has not been transferred to the developing roller 36 at the contact portion of the developing roller 36 with the intermediate roller 35 is recovered at the intermediate roller cleaning blade 351. The length c (width c) of the intermediate roller cleaning blade 351 in the axial direction of the intermediate roller is set to be shorter than the axial length of the intermediate roller 35 and longer than the width b of the contact member 352. Due to the above-mentioned relationship of length among the axial length of the intermediate roller 35, the width b of the contact member 352, and the width c of the intermediate roller cleaning blade 351, also in a case where liquid developer has been flowed out from the end portions of the contact member 352, it can be recovered at the intermediate roller cleaning blade 351, so that the formation of a liquid ring can be suppressed.

The axial length of the developing roller 36 and the width of the developing roller cleaning blade 361 are set to be longer than the width a of the recessed portion pattern forming region. Due to this relationship of length, image formation is possible and liquid developer that did not contribute to the image formation can be recovered.

Figure 12:
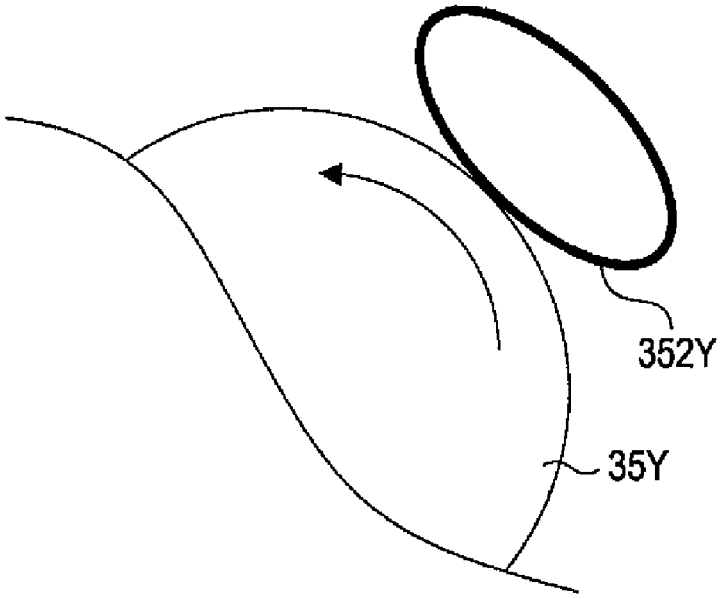
FIG. 12 is a view showing a contact member related to another embodiment of the invention.
Figure 13:
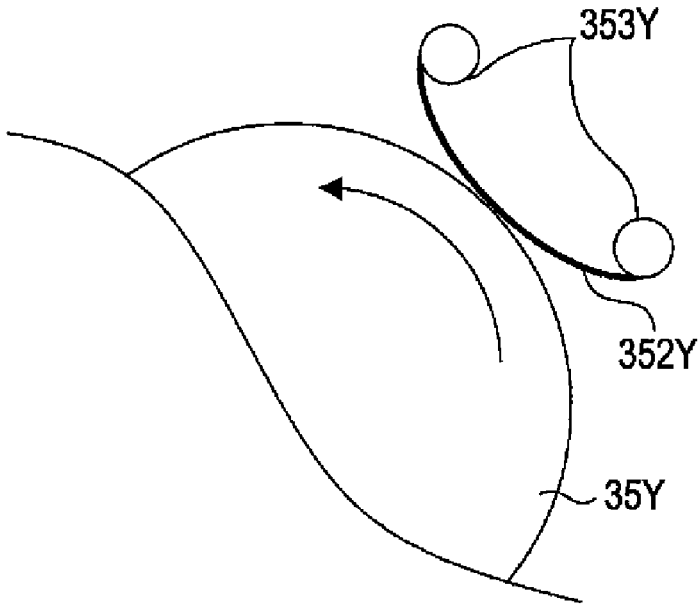
FIG. 13 is a view showing a contact member related to further another embodiment of the invention.

Next, other embodiments of the contact member 352 are explained with reference to FIGS. 12 and 13. Although a contact member 352 made of a PET film was explained in FIG. 6, other shapes can also be adopted as the contact member 352, as shown in FIGS. 12 and 13. The contact member 352 shown in FIG. 12 adopts a shape using a film formed into an endless tube shape. According to this shape, it can be confirmed that more stable contact than the film formed into a plate shape is obtained.

The contact member 352 shown in FIG. 13 adopts a configuration in which both ends thereof are supported by two support members 353. According to this configuration, the positions of two support members 353 can be independently adjusted, so that the contact pressure or the contact angle can be more minutely controlled. In both embodiments of FIGS. 12 and 13, the contact member 352 comes into contact with the intermediate roller 35 at its surface portion.

Figure 14:
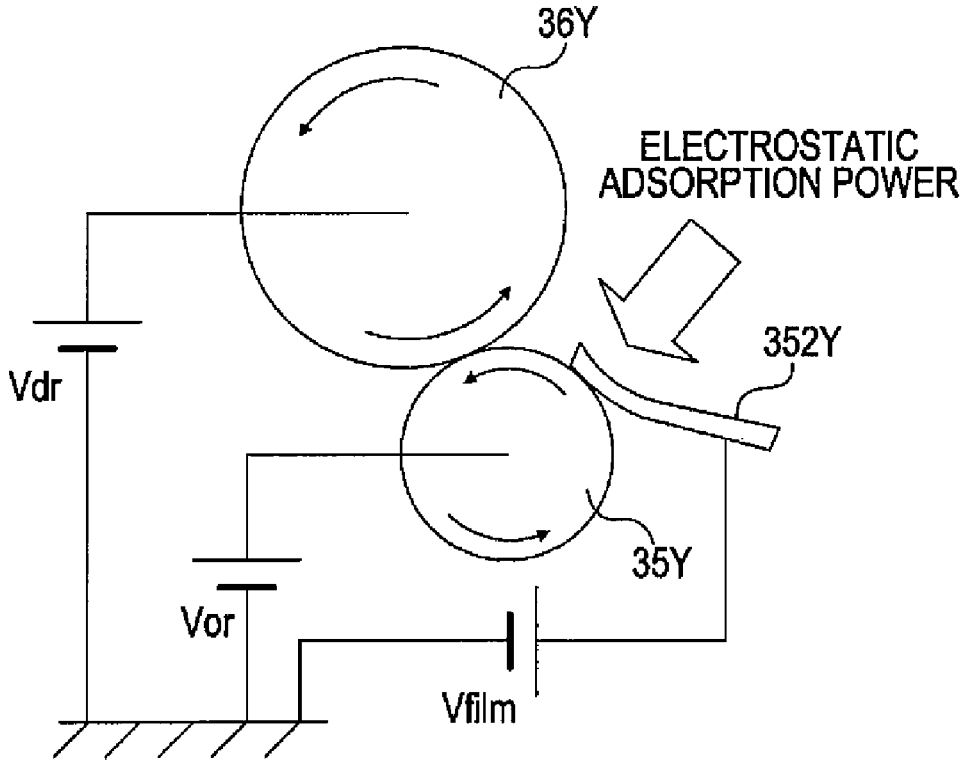
FIG. 14 is a schematic view showing the aspect of the bias voltage application to the intermediate roller, the developing roller, and the contact member.
Figure 15:
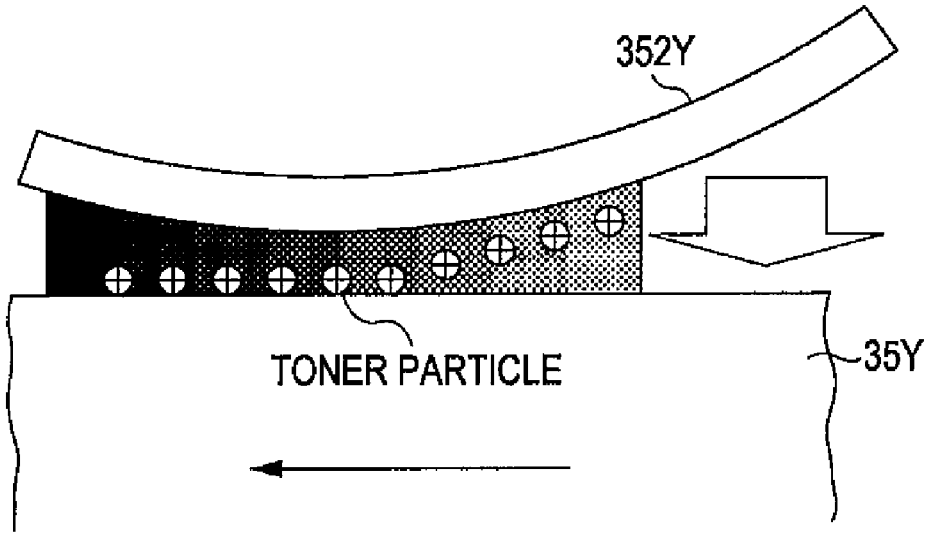
FIG. 15 is a schematic view showing toner movement by the application of a bias voltage.

Next, an embodiment for more reliably transferring toner particles is explained using FIGS. 14 and 15. In this embodiment, toner particles are transferred using electrostatic adsorption power. FIG. 14 is a view showing the aspect of applying a bias voltage to each component, and FIG. 15 is a view showing the aspect of toner particle transfer between the intermediate roller 35 and the contact member 352.

As shown in FIG. 14, an electric source serving as a bias voltage applying section is connected to the intermediate roller 35, the contact member 352, and the developing roller 36, and the predetermined voltages Vor, Vfilm, and Vdr are applied respectively. The voltage Vor applied to the intermediate roller 35 and the voltage Vfilm applied to the contact member 352 are set to have a magnitude relation of, for example, Vor>Vfilm. The voltage Vfilm applied to the contact member 352 may also be connected to a ground, and not to an electric source, and the magnitude relation of Vor<Vfilm may be adopted. In this manner, by providing a difference in electrical potential between the intermediate roller 35 and the contact member 352, electrostatic adsorption power acts between them, so that the contact force of the contact member 352 is increased, whereby it becomes possible to make the film thickness of liquid developer uniform. Also, the electrostatic adsorption power can be increased by optimizing the electric resistance value of the contact member 352. Specifically, the electrostatic adsorption power efficiently acts by setting the electric resistance value of the contact member 352 to be in a range of $10^6$~$10^{12}$ Ωcm. Also with respect to the contact members 352 of the other embodiments explained in FIGS. 12 and 13, similarly, by providing the bias applying section, it becomes possible to efficiently perform toner transfer.

Further, the amount of toner particles transferred from the intermediate roller 35 to the developing roller 36 can be controlled by making the electrostatic adsorption power to act on the toner particles by a difference in electrical potential between the intermediate roller 35 and the developing roller 36. In the case of positively-charged toner particles, by setting an electrical potential to be in the relation of Vdr<Vor, the toner particles are easily transferred to the developing roller 36, so that the amount of toner can be increased. Also, if an electrical potential is set to be in the relation of Vdr>Vor, the toner particles are difficult to be transferred, so that the amount of toner can be reduced.

Although not shown in the drawings, a configuration may also be made such that the electrostatic adsorption power acts on the toner particles by also providing a difference in electrical potential between the intermediate roller 35 and the supply roller 34. Also, this embodiment is characterized in that a difference in electrical potential is provided between the contact member 352 and the intermediate roller 35, and the bias applying section between the intermediate roller 35 and the developing roller 36 and between the supply roller 34 and the intermediate roller 35 may not be provided.

Although various embodiments of the invention have been explained above, the invention is not limited to these embodiments, and an embodiment constituted by appropriately combining the configurations of the respective embodiments also comes within the scope of the invention.

What is claimed is:

1. A developing device comprising:

a developer storage portion that stores a liquid developer including toner and carrier liquid;

a first coating member that rotates and coats the liquid developer stored in the developer storage portion;

a second coating member that comes into contact with the first coating member and rotates in a direction opposite to that of the first coating member;

a developer supporting body that comes into contact with the second coating member and rotates in the same direction as that of the second coating member;

and a contact member that comes into contact with the liquid developer coated on the second coating member by the first coating member, wherein the first coating member has a groove that is a recessed portion, and the length of the contact member in the axial direction of the second coating member is shorter than the axial length of the second coating member and longer than the axial length of the recessed portion forming region of the first coating member.

2. The developing device according to claim 1, wherein the contact member is an elastic body.

3. The developing device according to claim 1, wherein the contact member is a plate member and comes into contact with the second coating member at a surface portion.

4. The developing device according to claim 1, further comprising:

a bias applying section that forms a difference in electrical potential between the second coating member and the contact member.

5. An image forming apparatus comprising:

a liquid developer concentration adjusting section that adjusts the toner concentration of a liquid developer including toner and carrier liquid;

a transportation section that transports the liquid developer with the toner concentration adjusted at the liquid developer concentration adjusting section;

a developing section including a developer storage portion that stores the liquid developer transported by the transportation section, a first coating member that rotates and coats the liquid developer stored in the developer storage portion, a second coating member that comes into contact with the first coating member and rotates in a direction opposite to that of the first coating member, a developer supporting body that comes into contact with the second coating member and rotates in the same direction as that of the second coating member, and a contact member that comes into contact with the liquid developer coated on the second coating member by the first coating member; and a latent image supporting body that is developed by the developing section, wherein the first coating member has a groove that is a recessed portion, and the length of the contact member in the axial direction of the second coating member is shorter than the axial length of the second coating member and longer than the axial length of the recessed portion forming region of the first coating member.

6. The image forming apparatus according to claim 5, further comprising:

a driving control section that changes the rotary velocity of either the second coating member or the developer supporting body, and thus controls the peripheral velocity ratio of the second coating member and the developer supporting body.

* * * * *